US007828121B2

(12) United States Patent
Parrini

(10) Patent No.: US 7,828,121 B2
(45) Date of Patent: Nov. 9, 2010

(54) REINFORCED SYNTHETIC CABLE FOR ELEVATORS

(75) Inventor: Lorenzo Parrini, Affoltern am Albis (CH)

(73) Assignee: Inventio AG, Hergiswil NW (CH)

( * ) Notice: Subject to any disclaimer, the term of this patent is extended or adjusted under 35 U.S.C. 154(b) by 1223 days.

(21) Appl. No.: 10/717,805

(22) Filed: Nov. 20, 2003

(65) Prior Publication Data

US 2004/0110441 A1 Jun. 10, 2004

(30) Foreign Application Priority Data

Dec. 4, 2002 (EP) ..... 02027092

(51) Int. Cl.
*B66B 11/04* (2006.01)
*D02G 3/00* (2006.01)
*D02G 3/02* (2006.01)

(52) U.S. Cl. ..... 187/251; 428/372; 428/373; 428/374; 57/225

(58) Field of Classification Search ..... 428/375, 428/297.4, 299.4, 372, 373–374; 385/105; 57/216–217, 207, 225, 250, 258, 56, 223, 57/210, 236–7, 236–237; 87/6; 187/251, 187/254, 266
See application file for complete search history.

(56) References Cited

U.S. PATENT DOCUMENTS 3,475,898 A * 11/1969 Sharkey et al. ..... 428/372
4,022,010 A 5/1977 Gladenbeck et al.
4,034,547 A * 7/1977 Loos ..... 57/211
4,202,164 A * 5/1980 Simpson et al. ..... 57/232
4,412,474 A * 11/1983 Hara ..... 87/6
4,624,097 A 11/1986 Wilcox
4,640,179 A 2/1987 Cameron
4,877,422 A 10/1989 Walbridge et al.
4,887,422 A * 12/1989 Klees et al. ..... 57/220
4,956,039 A * 9/1990 Olesen et al. ..... 156/180
5,246,051 A * 9/1993 Inada et al. ..... 152/527
5,566,786 A * 10/1996 De Angelis et al. ..... 187/266
5,576,081 A * 11/1996 Sandt ..... 428/36.9
5,576,104 A * 11/1996 Causa et al. ..... 428/382
5,651,245 A * 7/1997 Damien ..... 57/220
5,749,211 A * 5/1998 Kimura et al. ..... 57/217

(Continued)

FOREIGN PATENT DOCUMENTS

EP 0252830 1/1988

(Continued)

OTHER PUBLICATIONS

Robert L. Mott, Applied Strength of Materials, Jul. 2001, Prentice Hall, 4th Edition, pp. 69-79.*

(Continued)

*Primary Examiner*—John Q Nguyen
*Assistant Examiner*—Stefan Kruer
(74) *Attorney, Agent, or Firm*—Fraser Clemens Martin & Miller LLC; William J. Clemens

(57) ABSTRACT

An elevator support, such as a cable or a belt connected with an elevator car or counterweight, has load-bearing synthetic material strands, which are reinforced by the introduction of a second phase and have a higher modulus of elasticity than that of the unreinforced strands.

15 Claims, 4 Drawing Sheets

U.S. PATENT DOCUMENTS

| | | | | |
|---|---|---|---|---|
| 5,830,304 | A * | 11/1998 | Priesnitz et al. | 156/166 |
| 6,162,538 | A * | 12/2000 | LaNieve et al. | 428/373 |
| 2001/0031594 | A1* | 10/2001 | Perez et al. | 442/339 |
| 2002/0000347 | A1 | 1/2002 | Baranda et al. | |
| 2006/0188718 | A1* | 8/2006 | Nitta et al. | 428/373 |
| 2008/0003430 | A1* | 1/2008 | Wilson et al. | 428/375 |
| 2008/0164051 | A1* | 7/2008 | Lee et al. | 174/131 A |

FOREIGN PATENT DOCUMENTS

| | | |
|---|---|---|
| EP | 0672781 | 9/1995 |
| WO | WO 94/20770 | 9/1994 |

OTHER PUBLICATIONS

Schwartz, Composite Materials Handbook, 1992, McGraw-Hill, Inc., 2nd Edition, pp. 2.66 -2.72.*

University of Plymouth, Composite Materials—Basic Concepts and Definitions, Jan. 19, 1999, pp. 1-8.*

P. Atkins, "Physikalische Chemie", VCH Weinheim, 1987, p. 201.

* cited by examiner

REINFORCED SYNTHETIC CABLE FOR ELEVATORS

BACKGROUND OF THE INVENTION

The present invention relates to a cable or belt used as a support means for elevators.

A drive pulley is often used in an elevator installation in order to move a car. In the case of such a drive pulley elevator, the drive pulley and the car are connected together by way of, for example, a cable. A drive unit sets the drive pulley into rotational movement. The rotational movement of the drive pulley is converted into linear movement of the car by a friction couple between the drive pulley and the cable. The cable then serves as a combined support and drive means, whilst the drive pulley serves as a force transmission means:

- in its function as a support means the cable supports an operating weight of the elevator, consisting of the empty weight of the car, the useful load of the elevator, an optional counterweight and the weight of the cable. The cable is in that case principally loaded by tension forces. For example, the car and the counterweight are suspended from opposite ends of the cable subject to gravitational force at the support means.
- in its function as a drive means for movement of the car the cable is pressed against a drive surface of the drive pulley. The cable is in that case subjected to compression and bending loads. For example, the cable is pressed by the operating weight of the elevator against a circumference of the drive pulley so that the cable and the drive pulley are disposed in friction couple.
- in its function as a force transmission means the drive pulley transmits the force of the drive to the cable. Important parameters in that case are a material-specific coefficient of friction between the drive pulley and the cable and a construction-specific angle of looping of the drive pulley by the cable.

Up to now steel cables have been used in elevator construction, which cables are connected with the drive pulley, the car and the counterweight. However, the use of steel cables is accompanied by certain disadvantages. Due to the high intrinsic weight of the steel cable, limits are placed on the travel height of an elevator installation. Moreover, the coefficient of friction between the metal drive pulley and the steel cable is so small that the coefficient of friction has to be increased by various measures such as special groove shapes or special groove linings in the drive pulley or by enlargement of the angle of looping. In addition, the steel cable acts as a sound bridge between the drive and the car which means a reduction in travel comfort. Expensive constructional measures are necessary in order to reduce these undesired effects. Moreover, steel cables tolerate, by comparison with synthetic material cables, a lesser bending cycle rate, are subject to corrosion and have to be regularly serviced.

Synthetic material cables normally consist of several load-bearing strands which are wound together and/or packed together, as can be seen from the patent documents: U.S. Pat. Nos. 4,877,422; 4,640,179; 4,624,097; 4,202,164; 4,022,010; and EP 0 252 830.

The U.S. Pat. No. 5,566,786 and the U.S. published application 2002/0000347 disclose the use of a synthetic material cable as a support or drive means for elevators, which is connected with the drive pulley, the car and the counterweight, wherein the cable consists of load-bearing synthetic material strands. The strand layer is covered, in the U.S. Pat. No. 5,566,786, by a sheath, the task of which consists of ensuring the desired coefficient of friction relative to the drive pulley and of protecting the strands against mechanical and chemical damage and ultraviolet radiation. The load is borne exclusively by the strands.

Notwithstanding the substantial advantages relative to steel cables, the synthetic material cables described in the U.S. Pat. No. 5,566,786 also demonstrate significant limitations, as also stated in the U.S. published application 2002/0000347.

Synthetic material cables demonstrate a very good longitudinal strength, which is, however, opposed by poor radial strength. The synthetic material cables tolerate, with difficulty, the load which is exerted on the outer surface thereof and which can lead to an undesired shortened service life of the cable. Finally, the modulus of elasticity of the synthetic material cables currently in use is too small for elevators with greater travel heights: undesired elongations of the cable occur and troublesome oscillations of the elevator which is set in motion are noticed by the user, particularly when the length of the cable has exceeded a specific limit.

Belts used as support or drive means are known from the U.S. published application 2002/0000347.

SUMMARY OF THE INVENTION

An object of the present invention is to propose a cable or belt as a support means or a drive means for elevators of the kind described above, which does not have the aforesaid disadvantages and by means of which travel comfort and safety are increased. In particular, the following disadvantages shall be eliminated: the undesired shortened service life of the cable, the too-small modulus of elasticity of the cable, the undesired elongations of the cable and the troublesome oscillations of the elevator set in motion.

The advantages achieved by the cable according to the present invention are essentially that the strands of a sheathed cable or belt, which consists of several layers, of synthetic material are reinforced by the introduction of a second phase into the aramid forming the fibers and thus have a higher modulus of elasticity than that of the unreinforced strands.

According to the classic definition of physical chemistry, by "phase" there is here meant a solid, fluid or gaseous body having physical and chemical properties, such as, for example, composition, modulus of elasticity, density, etc., which are homogeneous or at least vary without discontinuity (see P. Atkins, "Physikalische Chemie", VCH, Weinheim, 1987, page 201).

A phase is formally defined according to Gibbs as follows: a phase is a state of material in which with respect to its chemical composition and with respect to its physical state it is completely uniform.

This definition corresponds with the usual use of the word "phase". According to that, a gas or a gas mixture is a single phase; a crystal is a single phase; and two liquids fully miscible with one another similarly form a single phase. In addition, ice is a single phase, even if it is broken into small fractions. A mush of ice and water, conversely, is a system with two phases, even if it is difficult to localize the phase boundaries in this system.

An alloy of two metals is a two-phase system when the two metals are not miscible, but a single-phase system when they are miscible with one another.

The reinforced cable obtained in accordance with the present invention demonstrates a higher modulus of elasticity in the longitudinal direction than that of the unreinforced cable. Moreover, the reinforced cable according to the present invention also demonstrates a higher modulus of elasticity, a higher strength and higher breakage strain in a radial direction and a longer service life than those of the cable without reinforcement.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
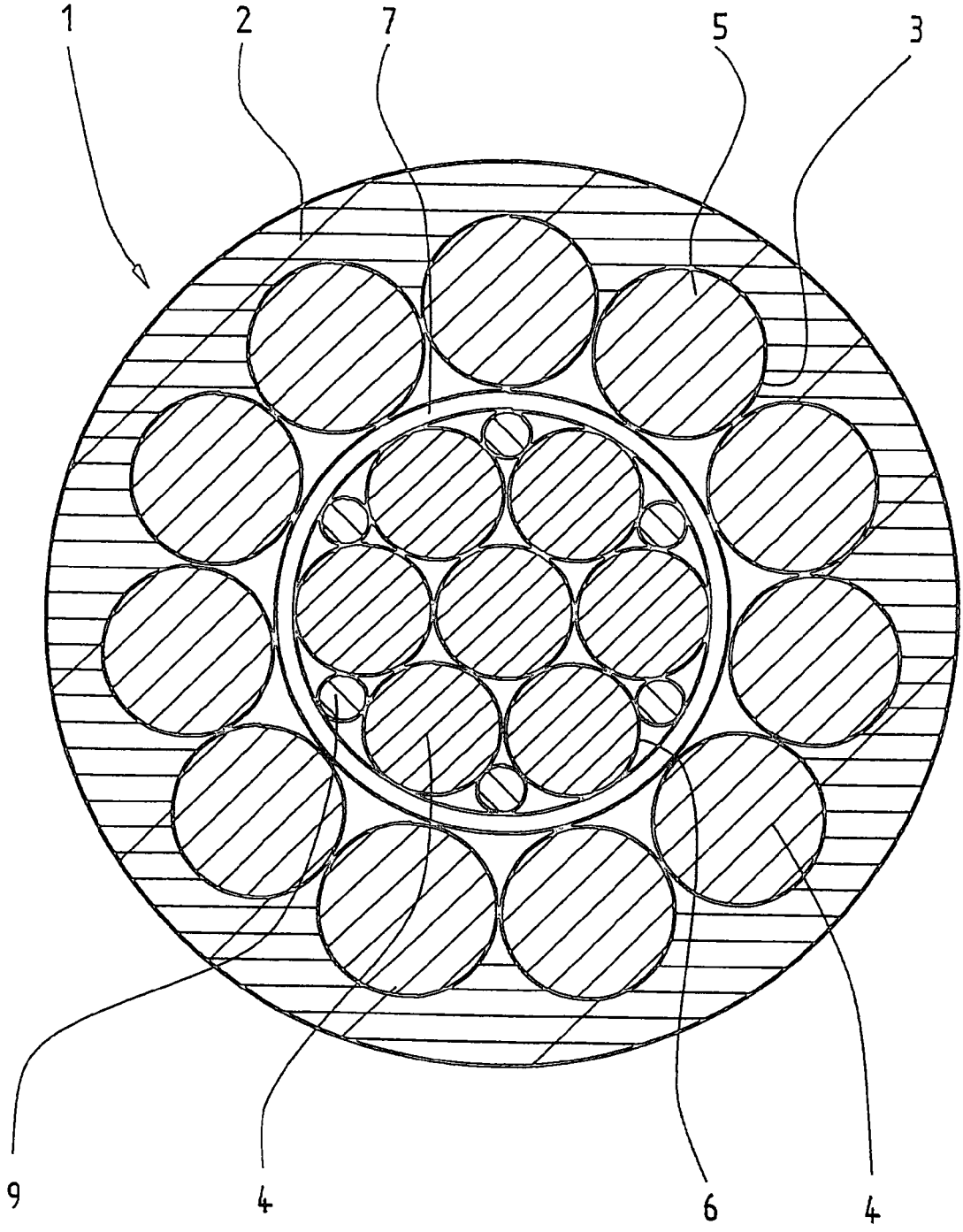
FIG. 1 (PRIOR ART)
FIG. 1 is a cross-sectional view through a conventional synthetic material cable according to the previous state of the art.

FIG. 1 shows a section through a conventional synthetic material cable 1. A sheath 2 surrounds an outermost strand layer 3. The sheath 2 is formed of synthetic material, for example polyurethane, that increases the coefficient of friction of the cable 1 on a drive pulley. The outermost strand layer 3 must have such high adhesion forces relative to the sheath 2 that this does not displace due to the thrust forces arising when the cable 1 is loaded or do not form wrinkles. These adhesion forces are achieved in that the synthetic material sheath 2 is injection-molded (extruded) in place so that all interstices in the outer strand carrier are filled and a large retention area is formed (see EP 0 672 781). The strands 4 are twisted or laid from individual fibers 5 of aramid material. Each individual strand 4 is treated with an impregnant, for example polyurethane solution, for protection of the fibers 5. The reverse bending strength of the cable 1 is dependent on the proportion of polyurethane of each strand 4. The higher the proportion of polyurethane, the higher the reverse bending strength. However, with an increasing polyurethane proportion the load-bearing capability diminishes and the modulus of elasticity of the synthetic fiber cable 1 decreases for the same cable diameter. The polyurethane proportion for impregnation of the strands 4 can lie between, for example, ten and sixty percent depending on the respectively desired reverse bending strength and transverse pressure sensitivity. Advantageously, the individual strands 4 can also be protected by a braided envelope of polyester fibers.

In order to avoid wear of the strands by mutual friction on the drive pulley a friction-reducing intermediate casing 7 is accordingly formed between the outermost strand layer 3 and the inner strand layer 6. Thus, in the case of the outermost strand layer 3 and in the case of the inner strand layers 6, which execute the majority of relative movements during bending of the cable at the drive pulley, the wear is kept small. Another means for prevention of friction wear at the strands 4 can be a resilient filler material which connects the strands 4 together without unduly reducing the flexibility of the cable 1.

A strand 4 is typically produced as follows: one thousand fibers 5 of twelve microns diameter form one yarn. Eleven to twelve yarns are thereafter laid to form a strand 4.

Figure 2:
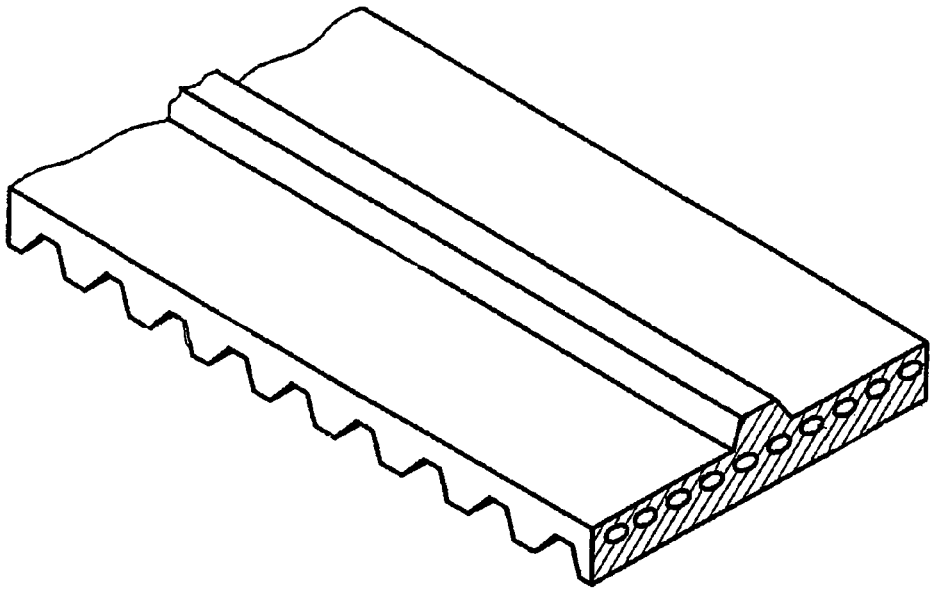
FIG. 2 (PRIOR ART)
FIG. 2 shows a fragment of a cogged belt.
Figure 3:
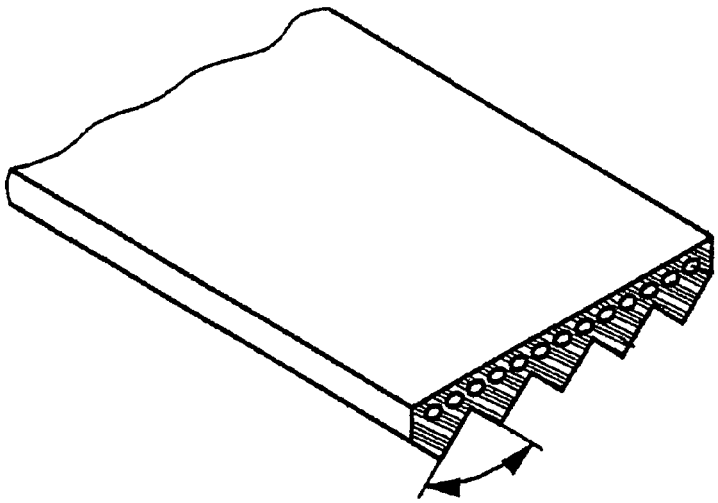
FIG. 3 (PRIOR ART)
FIG. 3 shows a fragment of a poly-V-belt.
Figure 4:
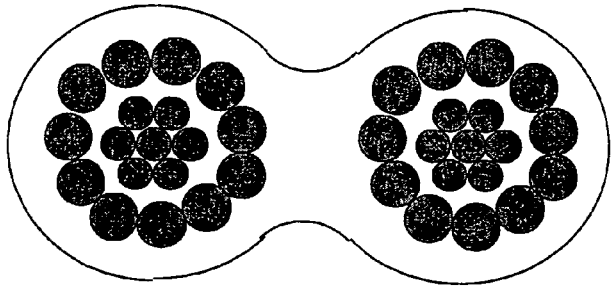
FIG. 4 (PRIOR ART)
FIG. 4 is a cross-sectional view of a twin cable (twin rope)

Obviously, the expert with knowledge of the present invention can also use the load-bearing cable without employment of a drive pulley. In addition, the expert can use an embodiment that is a double cable (twin rope) or a belt as shown in FIGS. 2 to 4. FIG. 2 shows a cogged belt, FIG. 3 shows a poly-V-belt and FIG. 4 shows a double cable. The various cable and belt configurations are all elongated load-bearing support devices.

As distinct from a pure retaining cable, driven elevator cables must be very compact and firmly twisted or braided so that they do not deform on the drive pulley or begin to rotate as a consequence of the intrinsic twist or deflection. The gaps and cavities between the individual layers of the strands 4 can therefore be filled by means of filler strands 9 which can have a supporting effect relative to the other strands 4 in order to obtain an almost circular strand layer 6 and increase the degree of filling and in order to form the circumferential envelope of the cable to be more round. These filler strands 9 (FIG. 5) consist of synthetic material, for example of polyamide.

The fibers 5, which consist of intensely oriented molecular chains of aramid, have a high tensile strength. By contrast to steel, the fiber 5 of aramid has, however, a rather low transverse strength due to its atomic construction. For this reason, conventional steel cable locks cannot be used for cable end fastening of synthetic fiber cables 1, since the clamping forces acting in these components significantly reduce the breakage load of the cable 1. A suitable cable end connection for synthetic fiber cables 1 has already become known through International application PCT/CH94/00044.

Figure 5:
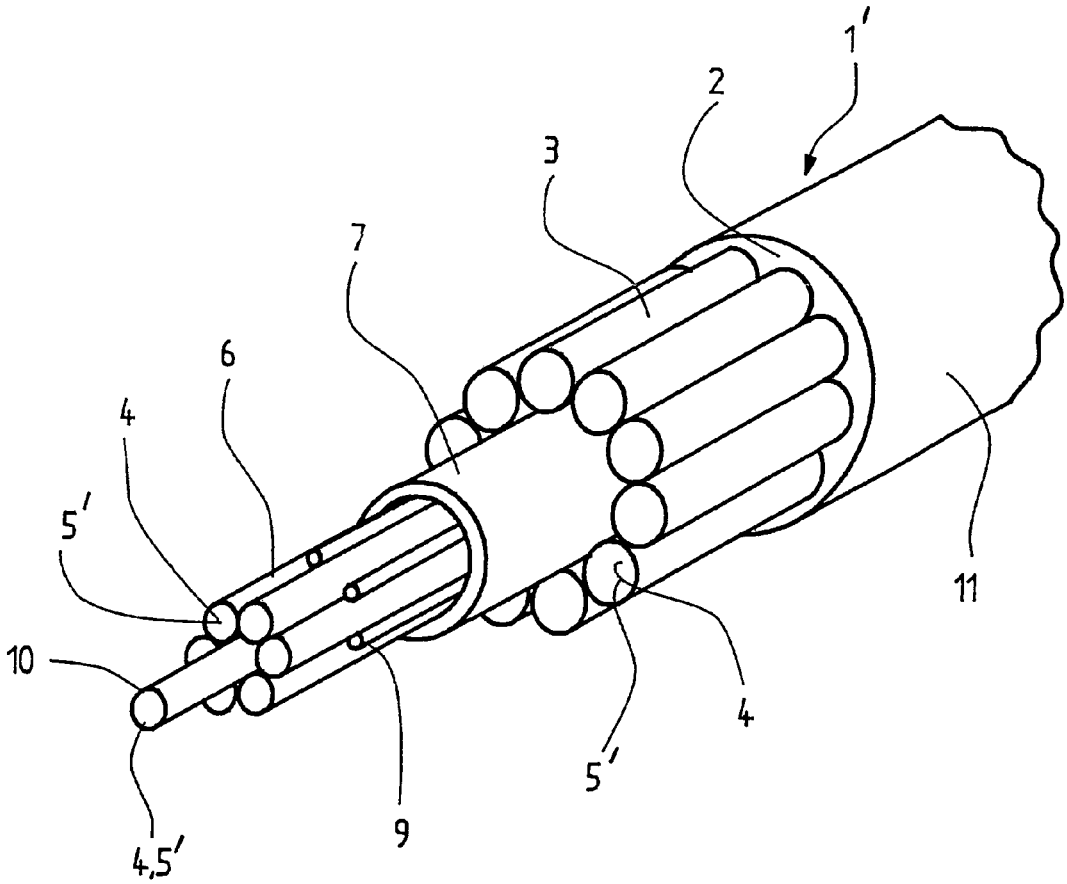
FIG. 5 is a perspective view of the conventional synthetic material cable according to the previous state of the art as shown in FIG. 1.

FIG. 5 shows a perspective illustration of the construction of the synthetic fiber cable 1' according to the invention. The strands 4 twisted or laid from fibers 5' of aramid are laid, inclusive of the filler strands 9, around a core 10 as layers with left-hand twist or right-hand twist. The friction-reducing intermediate casing 7 is disposed between the inner strand layer 6 and the outermost strand layer 3. The outermost strand layer 3 is covered by the sheath 2. A surface 11 of the sheath 2 can be structured for determining a defined coefficient of friction. The task of the sheath 2 consists of ensuring the desired coefficient of friction relative to the drive pulley and of protecting the strands 4 against mechanical and chemical damage and ultraviolet radiation. The load is borne exclusively by the strands 4. The cable 1' constructed from the fibers 5' of aramid has a substantially higher load-bearing capability by comparison to a steel cable for the same cross-section and has only a fifth to a sixth of the specific weight. Accordingly, for the same load-bearing capability the diameter of a synthetic fiber cable 1' can be reduced relative to a conventional steel cable. Through use of the above-mentioned materials the cable 1' is entirely protected against corrosion. Servicing as in the case of steel cables, for example in order to grease the cables, is no longer necessary.

Figure 6:
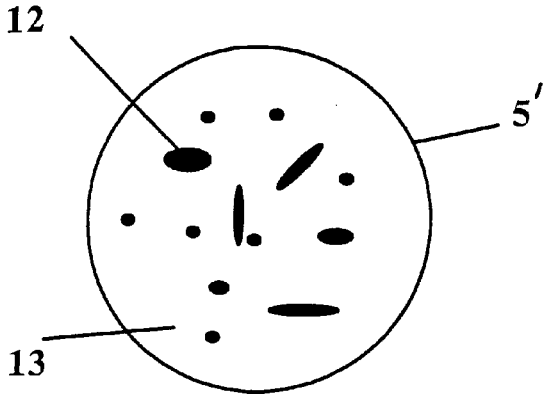
FIG. 6 is a cross-sectional schematic view of a reinforced fiber according to the present invention.
Figure 7:
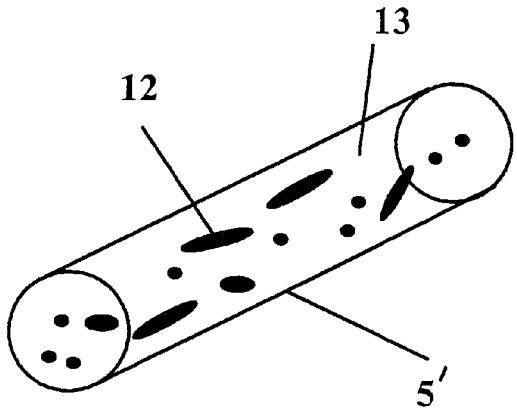
FIG. 7 is a perspective view of the reinforced fiber of FIG. 6.

FIG. 6 shows a schematic illustration of a section through a reinforced fiber 5' of aramid in accordance with the invention, whilst FIG. 7 is a perspective illustration of the fiber 5' reinforced in accordance with the present invention. The phase distribution is carried out in such a manner that aramid forms the first phase or base material and the reinforcing particles form the second phase. Particles 12, also termed second phase, are introduced and distributed in the base material 13. The second phase 12 demonstrates a higher modulus of elasticity than that of the first phase 13 or demonstrates at least mechanical and chemical properties of such a kind that the modulus of elasticity of the reinforced fiber of aramid is higher than that of the unreinforced fiber of aramid.

The second phase 12 can consist of, for example, a very hard synthetic material, a stiffer polymer than aramid, ceramic, carbon, glass, steel, titanium, particularly metal alloys and/or intermetallic phases. There is to be understood that "stiff" means a higher modulus of elasticity than that of aramid.

Figure 8:
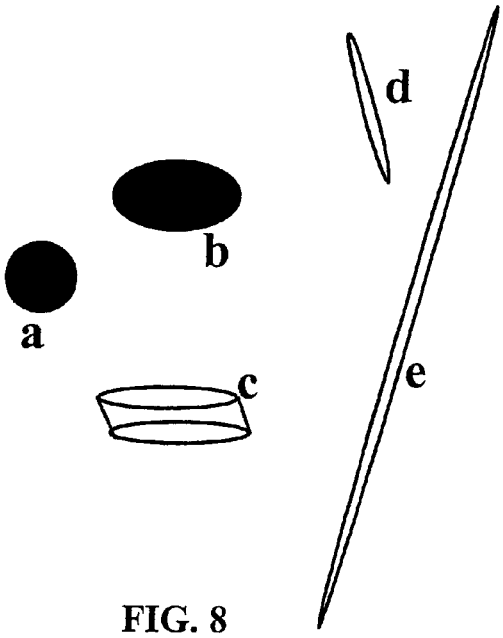
FIG. 8 is shows different geometric forms of the second phase reinforcing the fiber.

The geometric form of the particles 12 can lead to a distribution of spheres, capsules, globules, short and/or long fibers. FIG. 8 shows, for example, different geometric forms of the particles, which reinforce the fiber, of the second phase 12, which can adopt the form of spheres a, approximately spherical grains or capsules b, discs or small plates c, short fibers d or long fibers e, which are distributed in the matrix of aramid.

Figure 9:
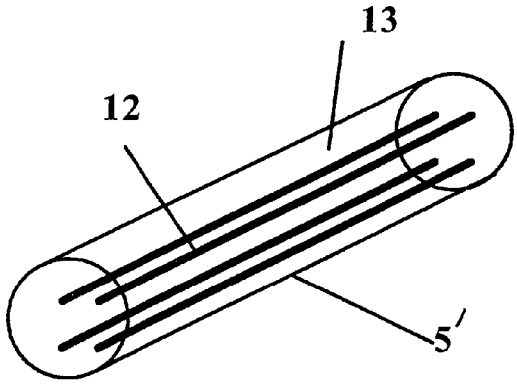
FIG. 9 is a perspective illustration of the reinforced fiber according to the invention, wherein the reinforcing second phase consists of fibers which are oriented in length and which are incorporated in the matrix of aramid and extend parallel to the fibers of aramid.

In the extreme case the fibers of the second phase 12 can be as long as the fibers 5' of aramid and extend, and be incorporated, parallel thereto as is illustrated in FIG. 9.

The distribution and density of the particles 12 is preferably homogeneous in the aramid base material 13. In the case of short and/or long fibers the orientation of the fibers can be random, as illustrated in FIG. 7, or have a preferential direction relative to the longitudinal direction of the fibers 5', as, for example, in FIG. 9.

Thanks to the effect of the reinforcing particles 12 in the first phase 13 the modulus of elasticity of the entire fiber in the longitudinal direction and/or in the transverse direction of the fiber 5' is increased. In addition, the breakage strain of the cable is increased and the service life of the cable extended by comparison with the case of the unreinforced cable.

The introduction of the second phase in order to optimize the mechanical properties of an aramid cable enables the known disadvantages of use of such a cable as support means for elevators to be avoided. The modulus of elasticity of the entire cable is so increased in the longitudinal direction as well as in the transverse direction that the requirements of the cable as support means for an elevator installation with high travel height can be achieved.

The service life as well as the breakage strength and elongation strength of the aramid cable reinforced in accordance with the present invention are substantially increased and thus satisfy by far the demands, which are imposed in the field of elevators, with respect to safety. At the same time, the weight of the reinforced aramid cable remains substantially smaller than that of a corresponding steel cable with comparable strength.

Methods for the production of a fiber, which is reinforced by microfibers, of aramid in such a manner as that of the present invention are disclosed in, for example, the U.S. published application 2001/0031594.

The base material 13 of the fibers 5' can also be replaced by other materials that have a sufficient strength such as steel, plastic, synthetic compositions and Zylon. The reinforcing particles 12 beyond this enable the use of materials as base material 13 which would not otherwise be considered without the positive effect of the reinforcement.

The introduction of reinforcing particles 12 into the first phase 13 is also conceivable in elevator cables which have a structure and arrangement of the strands different from that of the cable illustrated in FIG. 5.

Apart from elevator cables, elevator belts can also be reinforced by the particles 12 and thus have more suitable mechanical properties in order to be used as support means or drive means for elevators.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elongated load-bearing support with load-bearing strands each having a plurality of fibers, the strands being surrounded by a sheath, the strands comprising:

a plurality of load-bearing fibers formed of a base material being in a first phase; and a reinforcing material being in a second phase and being distributed in said base material whereby said reinforcing material increases a modulus of elasticity of the strands in a longitudinal direction of said fibers for supporting at least one of an elevator car and an elevator counterweight.

2. The support device according to claim 1 wherein the strands having said plurality of fibers are formed into one of a cable and a belt.

3. The support device according .to claim 1 wherein said base material is one of steel, plastic, synthetic compositions, aramid and Zylon and said reinforcing material increases a modulus of elasticity of each of said fibers in a radial direction of said fibers.

4. The support device according to claim 1 wherein said reinforcing material has a higher modulus of elasticity than a modulus of elasticity of said base material.

5. The support device according to claim 1 wherein said reinforcing material is arranged and distributed in said base material in the form of at least one of long fibers, short fibers, spheres, grains, capsules, discs and plates forming a matrix.

6. The support device according to claim 1 wherein said plurality of fibers is surrounded by a sheath.

7. An elongated load-bearing elevator support device with load-bearing strands each having a plurality of fibers; the strands being surrounded by a sheath, the strands comprising:

a plurality of fibers formed of a base material being in a first phase; and a reinforcing material being in a second phase and being distributed in said base material whereby said reinforcing material increases a modulus of elasticity of the strands in a longitudinal direction of said fibers for supporting at least one of an elevator car and an elevator counterweight .

8. The elevator support device according to claim 7 wherein said first phase base material is one of steel, plastic, synthetic compositions, aramid and Zylon, and said second phase reinforcing material increases a modulus of elasticity of said fibers in a radial direction of said fibers.

9. The elevator support device according to claim 7 wherein said reinforcing material has a higher modulus of elasticity than a modulus of elasticity of said base material.

10. The elevator support device according to claim 7 wherein said reinforcing material is arranged and distributed in said base material in the form of at least one of long fibers, short fibers, spheres, grains, capsules, discs and plates forming a matrix.

11. A method of producing an elongated elevator load-bearing support device comprising the steps of:

a. producing a plurality of fibers formed of a base material being in a first phase and reinforced by a reinforcing material being in a second phase and being distributed in said base material;

b. forming a plurality of load-bearing strands with said fibers; and c. surrounding said strands with a sheath to form the support device whereby the reinforcing material increases a modulus of elasticity of the strands in a longitudinal direction of the fibers for supporting at least one of an elevator car and an elevator counterweight.

12. The method according to claim 11 including a step of selecting the base material from steel, plastic, synthetic compositions, aramid and Zylon.

13. The method according to claim 11 including a step of selecting the reinforcing material to have a higher modulus of elasticity than a modulus of elasticity of the base material.

14. The method according to claim 11 including a step of selecting the reinforcing material to increase a modulus of elasticity of the fibers in a radial direction of the fibers.

15. The method according to claim 11 including a step of forming the reinforcing material as particles in the form of at least one of long fibers, short fibers, grains, capsules, spheres, discs and plates.

* * * * *